United States Patent [19]

Feigenbaum et al.

[11] Patent Number: 5,033,986

[45] Date of Patent: Jul. 23, 1991

[54] BODYWEAR HAVING INTEGRAL BRA SUPPORT

[75] Inventors: Jay Feigenbaum, Hamden; Janna Parris, Branford; Maurice Forman, Ridgefield, all of Conn.

[73] Assignee: Apparel America, Inc., New Haven, Conn.

[21] Appl. No.: 494,570

[22] Filed: Mar. 16, 1990

[51] Int. Cl.[5] ..... A41C 3/08

[52] U.S. Cl. ..... 450/30; 450/22; 450/31; 450/53; 450/59; 450/60; 450/61; 450/70; 2/67; 2/73

[58] Field of Search ..... 2/67, 73, 109, 110; 450/22, 27, 30, 31, 32, 36, 52, 53, 55, 56, 59, 60, 61, 70, 71, 74

[56] References Cited

U.S. PATENT DOCUMENTS

| | | | |
|---|---|---|---|
| 1,576,393 | 3/1926 | Wood | 450/70 |
| 1,890,507 | 12/1932 | Gifford | 2/67 X |
| 1,990,322 | 2/1935 | Goldberg . | |
| 2,097,777 | 11/1937 | Rothman | 2/67 |
| 2,118,958 | 5/1938 | Watinsky | 2/67 |
| 2,341,032 | 2/1944 | Freed et al. | 2/67 X |
| 2,359,804 | 10/1944 | Struthers | 450/32 |
| 2,592,265 | 4/1952 | Fyffe | 2/67 X |
| 2,612,641 | 10/1952 | Pion | 2/73 X |
| 2,612,642 | 10/1952 | Robins . | |
| 2,664,564 | 1/1954 | Funkelstein | 450/70 X |
| 2,700,160 | 1/1955 | Scholfield . | |
| 2,928,396 | 3/1960 | O'Dell | 2/73 X |
| 2,988,086 | 6/1961 | Rydin | 450/70 X |
| 3,161,200 | 12/1964 | Brickman . | |
| 3,255,754 | 6/1966 | Brumberger . | |
| 3,392,730 | 7/1968 | Relli | 450/30 |
| 3,665,929 | 5/1972 | Brantly | 450/70 |
| 3,683,419 | 8/1972 | Lewis | 2/67 |
| 3,698,399 | 10/1972 | Hand | 450/59 |
| 3,746,007 | 7/1973 | Hand et al. . | |
| 3,771,172 | 11/1973 | Barg | 2/67 |
| 4,143,662 | 3/1979 | Fisher | 450/53 |
| 4,372,320 | 2/1983 | Silber | 2/67 X |
| 4,398,538 | 8/1983 | Johnson | 2/67 X |
| 4,440,174 | 4/1984 | Cordova . | |
| 4,654,894 | 4/1987 | Kudo | 2/67 |
| 4,798,557 | 1/1989 | Scott | 450/31 |
| 4,916,755 | 4/1990 | Feigenbaum et al. . | |

FOREIGN PATENT DOCUMENTS

| | | | |
|---|---|---|---|
| 0479639 | 12/1951 | Canada | 450/61 |
| 956752 | 10/1974 | Canada | 450/61 |
| 658762 | 3/1938 | Fed. Rep. of Germany | 2/67 |
| 844284 | 1/1953 | Fed. Rep. of Germany | 450/53 |
| 2541297 | 3/1977 | Fed. Rep. of Germany | 2/67 |
| 0870469 | 3/1942 | France | 450/53 |
| 0919909 | 8/1945 | France | 450/36 |
| 0913541 | 9/1946 | France | 450/53 |
| 1223482 | 6/1960 | France | 450/36 |
| 1375119 | 9/1964 | France | 450/30 |
| 0056097 | 4/1944 | Netherlands | 450/53 |
| 0365258 | 1/1932 | United Kingdom | 450/61 |

OTHER PUBLICATIONS

Jogbra Sports Bra Packaging.

*Primary Examiner*—Werner H. Schroeder
*Assistant Examiner*—Jeanette E. Chapman
*Attorney, Agent, or Firm*—DeLio & Associates

[57] ABSTRACT

A woman's bodysuit for exercising or swimming comprises an outer covering for encasing at least a portion of a woman's torso, including the bust, abdomen, hips and rear regions. The covering extends below the arms and around at least a portion of the back and includes shoulder straps forming openings for the neck and arms. A bra portion is provided beneath the outer covering, the bra portion including a full bra liner covering the breasts and a separate partial bra liner beneath the full liner supporting the undersides and sides of the breasts. The full and partial bra liners are each secured along common edges to the outer covering centrally between the shoulder straps at the neck opening and on either side at the arm openings. An elastic strap is secured along a bottom edge of the bra portion and is secured to the outer covering in the region behind or below the arms. The outer covering, full bra liner and partial bra liner are made of stretchable natural or synthetic fabrics, or blends thereof. The outer covering and full bra liner fabrics have greater stretchability than the partial bra liner fabric and the full bra liner fabric has greater stretchability than the outer covering fabric.

3 Claims, 2 Drawing Sheets

BODYWEAR HAVING INTEGRAL BRA SUPPORT

BACKGROUND OF THE INVENTION

This invention relates to a women's bodysuit for use in exercising or swimming, and, in particular, to a women's bodysuit which has an integral supporting bra.

The construction of women's bodysuits used for various activities such as exercising, swimming and the like requires that the bodysuit be soft and resilient so as to be comfortable to the wearer. However, such construction also requires that there be extra support in the bust region to provide comfort during such activities. Past approaches to swim- or bodysuit construction have included various designs in which a bra is incorporated within the suit, such as those disclosed in U.S. Pat. Nos. 4,398,538 to Johnson; 3,255,754 to Brumberger; 3,161,200 to Brickman; and 2,700,160 to Scholfield. Other approaches have been to provide no integral bra and to use a separate sports-type bra under athletic garments such as bodysuits. These approaches have generally compromised comfort and/or support and have not been satisfactory.

Modern women's bodysuits have also incorporated natural, synthetic, or natural/synthetic fabric blends of various degrees of stretchability to provide overall support to the wearer. However, such approaches using fabric blends alone have not been successful in providing the support and comfort required for the wearer.

Bearing in mind the problems and deficiencies of the prior art, it is therefore an object of the present invention to provide a supportive women's bodysuit of a construction which may be utilized in a variety of athletic and other activities, including exercising and swimming.

It is another object of the present invention to provide a women's bodysuit which is soft and comfortable to the wearer, yet provides particular support in the bust region.

It is yet another object of the present invention to provide a women's bodysuit which achieves the aforementioned objects by the use of an integral bra support.

It is a further object of the present invention to provide a women's bodysuit meeting the aforementioned objects which is easy to manufacture and which utilizes available materials of reasonable cost.

SUMMARY OF THE INVENTION

The above and other objects, which will be apparent to those skilled in the art, are achieved in the present invention which provides a women's bodysuit for use in various activities such as exercising or swimming which comprises an outer covering for encasing at least a portion of a woman's torso, including the bust region, with the covering extending below the arms and around at least a portion of the back and including straps for securing the covering over the shoulders. A bra portion is provided beneath the outer covering, the bra portion including a full bra liner covering the breasts and a separate partial bra liner supporting the undersides and sides of the breasts. The full and partial bra liners are each secured along common edges to the outer covering in the region centrally between the shoulder straps and on either side adjacent to the arms. Preferably, the full and partial bra liners are secured to the outer covering centrally at the neck opening and on either side at the arm openings formed by the shoulder straps.

The outer covering, full bra liner and partial bra liner are made of soft, stretchable natural or synthetic fabrics, or blends thereof. Preferably, the partial bra liner is made of a fabric with restrictive stretchability, the full bra liner is made of a fabric with high stretchability, and the outer covering is made of a fabric with stretchability between the two.

DESCRIPTION OF THE INVENTION

In describing the preferred embodiments of the present invention, reference is made herein to FIGS. 1–4 in which like numerals refer to like features of the invention.

Figure 1:
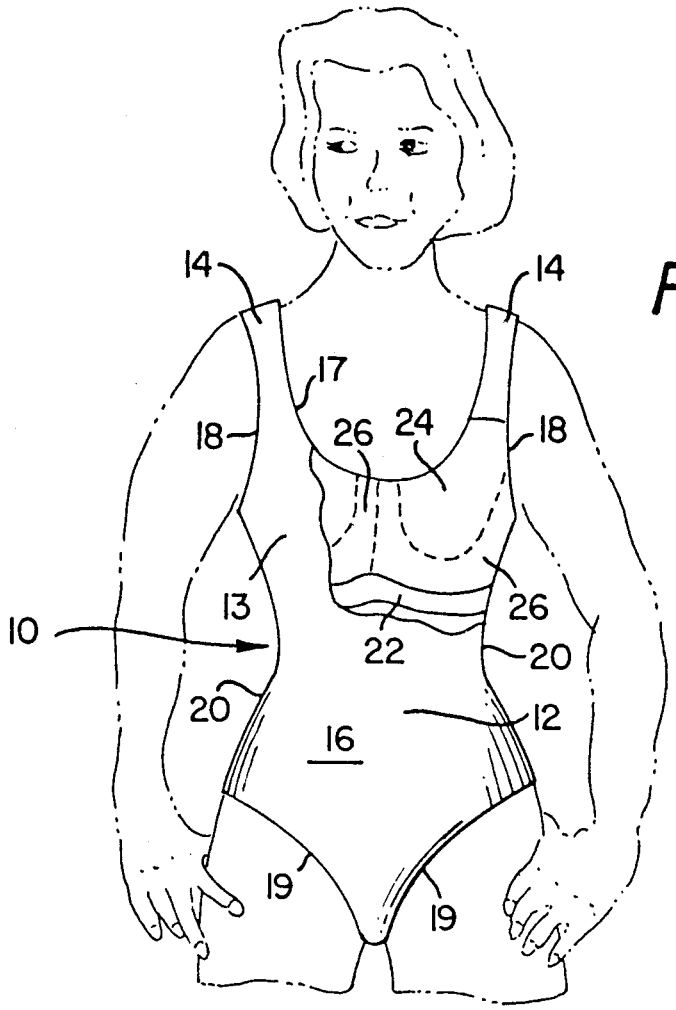
FIG. 1 is a front view of the preferred embodiment of the present invention with the outer covering of the bodysuit partially cut away to show the integral bra support.
Figure 2:
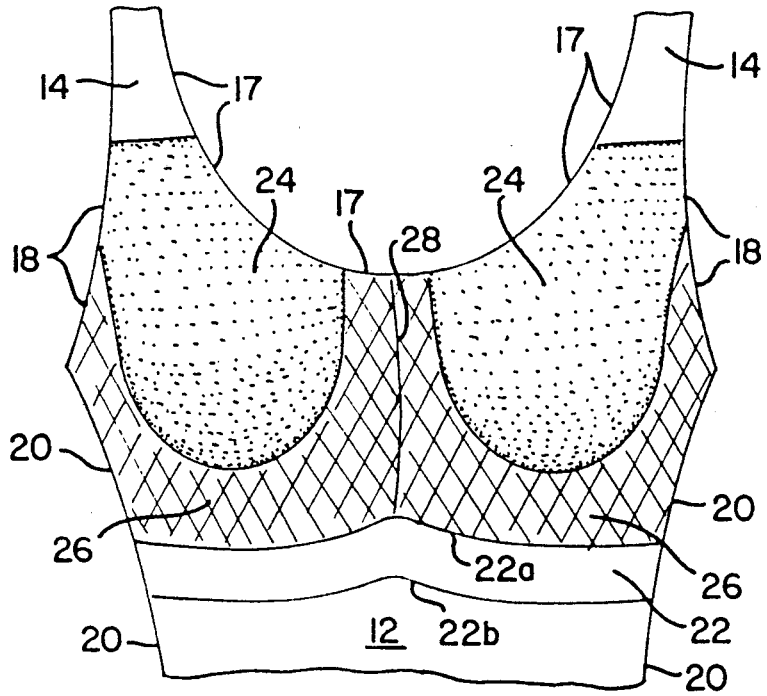
FIG. 2 is a rear view of the integral bra portion of the present invention as seen from inside the bodysuit depicted in, FIG. 1.

A front view of the preferred embodiment of the invention is depicted in FIG. 1 in a partially cut away view of bodysuit 10. The bodysuit may be made for use in various activities, such as exercising, swimming or the like, or may be made for use as an undergarment where desired. Bodysuit 10 includes an outer covering 16 made of a natural, synthetic or natural/synthetic blend fabric suitable for the desired end use, such as spandex, nylon, polyester, cotton or blends thereof. The fabric should be a soft, stretchable, and resilient while still providing a moderate degree of support for the portion of the woman's torso which it encases.

As shown in the figures, the outer covering 16 encases at least the bust region of a woman's torso and preferably covers the abdomen, hips and rear areas as well, i.e., those portions of a women's torso conventionally covered by a womens' one piece swimsuit. Covering 16 extends below the arms and around at least a portion of the back and includes shoulder straps 14 which extend upward from the top of the bust region 13 as shown in FIG. 1. The shoulder straps form a neck opening 17 and a pair of arm openings 18. The lower portion of outer covering 16 below abdomen region 12 includes a pair of leg openings 19 for the wearer. The front and rear portions of outer covering 16 may be made of separate fabric panels, in which case they are sewn or otherwise secured along side seams 20.

Figure 3:
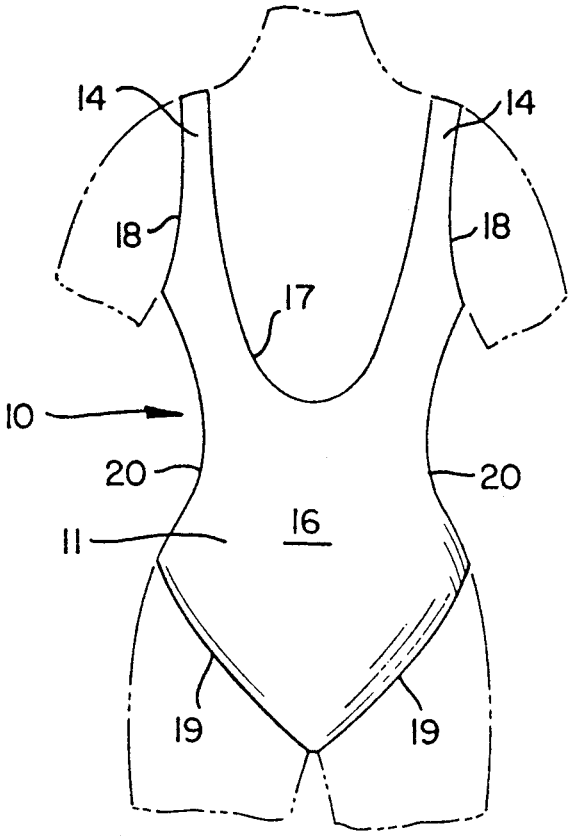
FIG. 3 is a rear view of the bodysuit depicted in FIG. 1.
Figure 4:
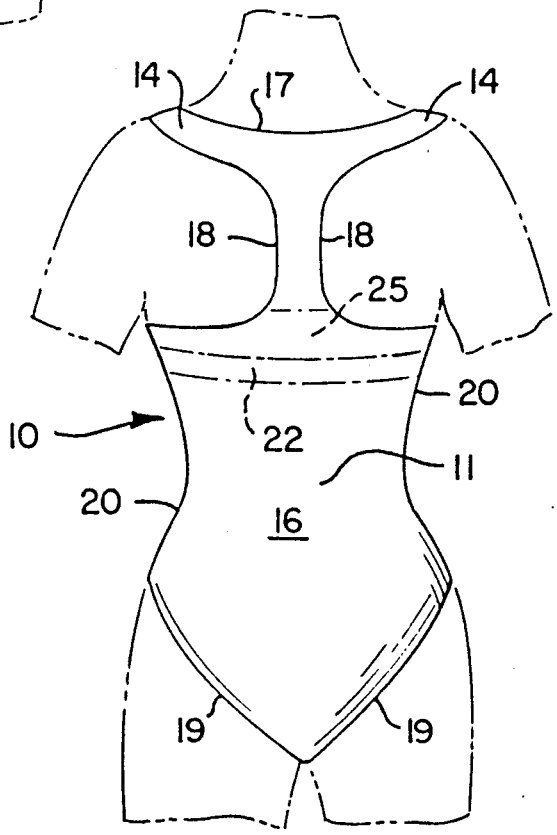
FIG. 4 is a rear view of an alternate embodiment of the bodysuit depicted in FIG. 1.
Figure 2:
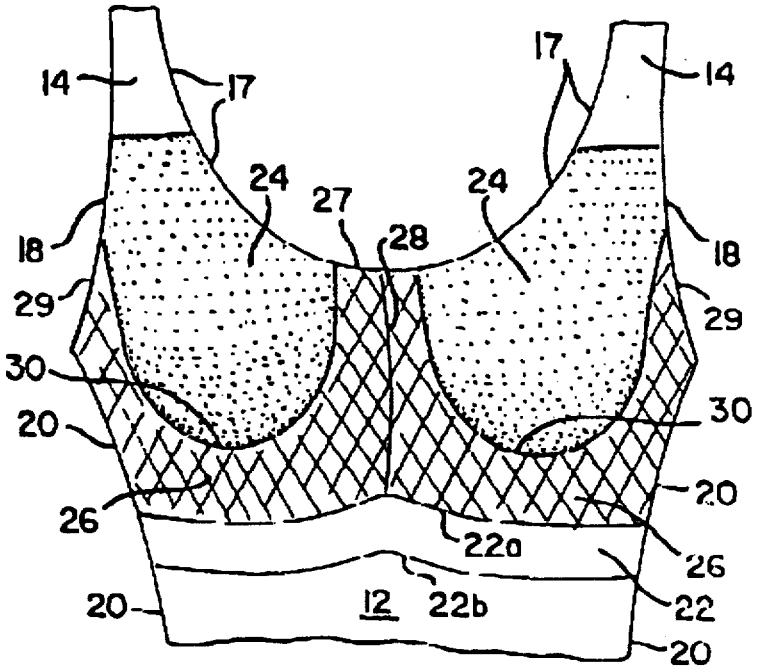

The rear view of the bodysuit 10 is depicted in alternate embodiments in FIGS. 3 and 4, respectively. In each embodiment, outer covering 16 wraps around the body beneath the arm openings 18 to a rear portion 11 which covers as least a portion of the back of the wearer. In the first embodiment shown in FIG. 3, the shoulder straps 14 define a conventional "scoop" back in which the neck opening 17 extends down to a point above the waist of the wearer. In the alternate embodiment shown in FIG. 4, the shoulder straps 14 define a T" style back in which the neck opening 17 does not extend as far down the back of the wearer while the arm openings 18 extend well into the back of the wearer. Any other type of construction along the back region of the suit may be utilized to provide support, but such construction should provide cross support as high as possible and preferably no lower than the waist of the wearer.

Turning again to FIG. 1, the partially cut away view of the front of outer covering 16 reveals the integral bra support beneath bust region 13. The integral bra is normally completely covered by outer covering 16 and includes a first full, outer bra liner 24 which covers the breasts of the wearer. Beneath this full bra liner there is a separate, partial bra liner which supports the undersides and sides of the breasts, and does not extend over the central or upper portions thereof. As seen best in the rear view in FIG. 2, the central portion 27 of the partial bra liner 26 extends upward between the breasts to the neck opening 17 of the outer liner in the region centrally between the shoulder straps 14. The sides 29 of the partial bra liner 26 extend upward adjacent to the arms and to the edge of the arm openings 18 of the outer covering, below the straps 14. These central and side edge portions 27, 29 of the partial bra liner 26 are secured by sewing along common edges with the full bra liner to secure both the full and partial bra liners to the respective neck opening 17 and arm openings 18 of the outer covering.

Optionally, the other portions of the top and side edges of the full bra liner 24 which are common to the outer covering neck and arm openings may be secured by sewing to the outer covering 16 at those openings. The edges 30 of the partial bra liner 26 which extend downward and between the secured portions at the neck and arm openings are preferably left free and unsecured to both the full bra liner 24 or the outer covering 16, as shown in the preferred embodiment in the figures, to provide a measure of support independent of the full bra liner. A central seam 28 may be sewn to secure the full and partial bra liners to one another along the center of the bra portion. Either one or both of the full and partial bra liners may also be sewn at their side edges to the side seams 20 of the outer covering.

To hold the lower front edge of the integral bra portion in place on the wearer, there is provided an elastic strap of approximately one inch (1") width which is secured at its upper edge **22*a* to both the full and partial bra liners along their entire common front edges. The lower edge 22*b* of elastic strap 22 may be left free as shown in the preferred embodiment. In an alternate embodiment, the lower edge of this elastic strap 22** may be secured to an inner liner (not shown) which extends around the body of the wearer, underneath the outer covering. This inner liner may be of the type which incorporates control panels to restrict stretching thereof and control bulging at desired areas of the body, as described and claimed in co-pending application Ser. No. 259,973 of the instant inventors, the disclosure of which is hereby incorporated by reference.

The elastic strap 22 may be secured at its opposite ends to the side seams 20, joining the front and back portions of outer covering 16, at the regions just below or slightly behind the arm openings 18. This arrangement holds the strap against the body of the wearer in a comfortable manner. In an alternate embodiment depicted in FIG. 4, a rear portion 25 of the full bra liner and the elastic strap 22 secured thereto may extend completely around the body of the wearer to provide a tight yet comfortable fit. In this latter arrangement, while the top edge of the full bra liner rear potion 25 may be secured to the outer covering, the elastic strap 22 would not be secured to outer covering 16 but would instead ride essentially independently of the outer covering.

In the construction of the integral bra portion as described above, it is important that the partial bra liner 26 be secured to the outer covering 16 in a central region between the breasts at the neck opening 17 and along the sides at the arm openings 18. This construction, along with the provision of the elastic strap securing the lower edges of the integral bra support provide the required degree of support of the bust region during times of moderate or intense motion or activity by the wearer.

While the fabric used in both the full and partial bra liners may be of the same types as those disclosed for use in the outer covering, it is preferred that the partial bra liner have more restrictive stretch characteristics than the fabric selected for the outer covering 16 to provide good support for the bust region. The fabric for the full bra liner 24 is preferred to have a greater degree of stretchability, and less restrictiveness, than the fabric of the outer covering to provide maximum comfort to the wearer. The various different degrees of stretchability and restrictiveness can be controlled by selecting different types of fabrics or by selecting different weights and/or knits of the fabric. For example, the partial bra liner can be made of a leno knit which provides less stretchability and more restrictiveness. As a result of construction and suitable fabric selection, as described above, the bodysuit of the present invention both supports and holds the bust of the wearer while retaining maximum overall comfort during various activities.

While this invention has been described with reference to specific embodiments, it will be recognized by those skilled in the art that variations are possible without departing from the spirit and scope of the invention, and that it is intended to cover all changes and modifications of the invention disclosed for the purposes of illustration which do not constitute departure from the spirit and scope of the invention.

Having thus described the invention, what is claimed is:

1. A woman's bodysuit comprising:

an outer covering for encasing at least a portion of a woman's torso, including the bust, abdomen, hips and rear regions, said covering extending below the arms and around at least a portion of the back and including shoulder straps forming openings for the neck and arms and made of a stretchable natural or synthetic fabric or blends thereof;

a bra portion extending beneath the front of said outer covering and having side edges ending beneath the arm openings and made of a stretchable natural or synthetic fabric or blends thereof, said bra portion including a full bra liner covering the breasts and a separate partial bra liner beneath the full liner supporting the undersides and sides of the breasts, said full and partial bra liners each being secured along common edges to each other and said outer covering centrally between the shoulder straps at the neck opening and on either side at the arm openings, said partial bra liner being unsecured to said full bra liner in the regions between the central and side regions of attachment to said outer covering and made of a fabric having less stretchability than both the outer covering and full bra liner to provide support independent of the full bra liner; and an elastic strap secured along a bottom edge of said bra portion to both the full and partial bra liners, opposite ends of said strap being secured to said outer covering along seams below the arm openings, to hold said bra against the body of the wearer.

2. The bodysuit of claim 1 wherein said full bra liner is secured to said outer covering along the entire neck opening between said shoulder straps and along the arm openings from said shoulder straps to below said arms.

3. The bodysuit of claim 1 wherein said full and partial bra liners are additionally secured to said outer covering along said seams below said arm openings.

* * * * *

UNITED STATES PATENT AND TRADEMARK OFFICE

CERTIFICATE OF CORRECTION

PATENT NO. : 5,033,986

DATED : JULY 23, 1991

INVENTOR(S) : FEIGENBAUM ET AL.

It is certified that error appears in the above-identified patent and that said Letters Patent is hereby corrected as shown below:

DELETE FIG. 2 AND SUBSTITUTE FIG. 2 AS SHOWN ON

ATTACHED SHEET.

Signed and Sealed this

First Day of December, 1992

*Attest:*

DOUGLAS B. COMER

*Attesting Officer*

*Acting Commissioner of Patents and Trademarks*